US006848849B2

(12) United States Patent
Kobayashi

(10) Patent No.: US 6,848,849 B2
(45) Date of Patent: Feb. 1, 2005

(54) MEDIUM SUPPLYING APPARATUS

(75) Inventor: Naomi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/652,425

(22) Filed: Aug. 29, 2003

(65) Prior Publication Data

US 2004/0042819 A1 Mar. 4, 2004

(30) Foreign Application Priority Data

Aug. 30, 2002 (JP) ..... 2002-255183

(51) Int. Cl.[7] ..... B41J 11/58; G03G 15/23
(52) U.S. Cl. ..... 400/624; 271/3.03; 399/402
(58) Field of Search ..... 400/624; 399/124, 399/364, 393, 401, 402; 271/3.01, 3.03, 65, 163, 301

(56) References Cited

U.S. PATENT DOCUMENTS 4,553,831 A * 11/1985 Dixon ..... 355/26
4,884,110 A * 11/1989 Tsurubuchi et al. ..... 399/402
6,145,828 A * 11/2000 Arai ..... 271/3.03
2002/0054777 A1 * 5/2002 Itoh et al. ..... 399/401
2002/0074720 A1 * 6/2002 Kato et al. ..... 271/264

* cited by examiner

*Primary Examiner*—Stephen R. Funk
(74) *Attorney, Agent, or Firm*—Akin Gump Strauss Hauer & Feld, LLP

(57) ABSTRACT

The present invention provides a medium supplying apparatus that enables a user to easily remove medium and prevents medium from slanting or transferring improperly. The medium supplying apparatus comprises a first frame and a second frame that rotates freely with respect to the first frame. The first frame includes a first rotating section that rotates freely, a first fulcrum coupling section constructing a rotating fulcrum and a first lock coupling section. The second frame includes a pressing member, a second fulcrum coupling section constructing the rotating fulcrum by being coupled with the first fulcrum coupling section, and a second lock coupling section coupled selectively with the first lock coupling section. Because the first and second lock coupling sections are coupled selectively by relative movement, the second frame is locked or unlocked with respect to the first frame.

5 Claims, 11 Drawing Sheets

MEDIUM SUPPLYING APPARATUS

BACKGROUND OF THE INVENTION

1. Field of the Invention

The invention relates to a medium supplying apparatus.

2. Related Background Art

Conventionally, in an image forming apparatus, for example, a printing apparatus, a copying apparatus or a facsimile apparatus, in order to supply sheets serving as medium, a medium supplying apparatus is installed. The medium supplying apparatus comprises a reversing unit to reverse the sheet for recording on both sides of the sheet.

FIG. 2 is a summary drawing showing a conventional printing apparatus.

In FIG. 2, 11 is a printing apparatus, 12 is a sheet cassette; 13 is a sheet supplying roller which is set at the front end (that is, the right end in FIG. 2) for sending out the sheet (not shown) to a conveyance route Ra; 14 is a conveyance roller for conveying the sheet sent out; 15 is a registry roller, 16 is a photoconductor drum; 16*a* is a transferring roller set such as pressing upon the photoconductor drum 16; and 17 is a fixing device. The fixing device 17 includes a heating roller 52 and a pressure roller 53.

Further, 18 is a separator which is set at a position a or a position b and is used for making alternatively the conveyance route Ra join with a conveyance route Rb or with a conveyance route Rc; and 19 is a reversing unit used for duplex printing.

The reversing unit 19 includes an upper frame 20 and an under frame 21. On the upper frame 20, a plurality of pinch rollers 22 are installed, and on the under frame 21, a plurality of conveyance rollers are mounted. Further, in the reversing unit 19, a reversing roller 54 is set for reversing the sheet conveyed from the conveyance route Rb and for sending the reversed sheet to a conveyance route Rd.

Moreover, the upper frame 20 is installed at a fulcrum 27 such as opening and shutting freely. When the upper frame 20 is set horizontally at a shut position to face the under frame 21, each pinch roller 22 is pressed against corresponding conveyance rollers 23 by springs (not shown).

Next, the operation of the printing apparatus with the above construction is explained.

To perform duplex printing, first the sheet is sent out from the sheet cassette 12 by the sheet supplying roller 13, and is conveyed to the conveyance route Ra by the conveyance roller 14. Then, the sheet is printed on its one side and is conveyed to the separator 18. At this time, the separator 18 is set at the position a, so the sheet is sent toward the reversing unit 19.

Further, after the sheet is reversed and is conveyed to the conveyance route Rd between the upper frame 20 and the under frame 21 by the pinch rollers 22 and the conveyance rollers 23, the sheet is sent out again by the sheet supplying roller 13 and is conveyed again to the conveyance route Ra by the conveyance roller 14. Then, the sheet is printed again on its other side and is conveyed again to the separator 18. At this time, the separator 18 is set at the position b, so the sheet is sent to the conveyance route Rc and is output to the outside of the printing apparatus 11.

The reversing unit 19 and the upper frame 20 can be locked to the under frame 21. Accordingly, on either of the right end and the left end (in FIG. 2, the front end and the back end) of the under frame 21, a lock lever 26 is mounted such that it rotates around a fulcrum 55. On the lock lever 26, a ditch 56 is formed. Further, corresponding to the ditch 56, a coupling bar 28 is mounted on the upper frame 20.

When the lock lever 26 rotates in a counterclockwise direction, the upper frame 20 is locked. On the contrary, when the lock lever 26 rotates in a clockwise direction, the upper frame 20 is unlocked. Moreover, by using a spring 25 in the lock lever 26, the lock lever 26 is accompanied along the clockwise direction. Thus, when the upper frame 20 rotates to the shut position, the upper frame 20 is locked automatically at the under frame 21.

When the reversing unit 19 is clogged with a sheet, there is a need to pull out the reversing unit 19 from the printing apparatus 11 and to make the lock lever 26 rotate to unlock the upper frame 20 with respect to the under frame 21. Thus, by making the upper frame 20 rotate to an inclining position, i.e. an open position with respect to the under frame 21, it is possible to remove the sheet.

However, in the conventional printing apparatus 11, because the lock lever 26 is set at both ends (in FIG. 2, the front end and the back end) of the under frame 21, it is necessary to use both hands to operate the lock lever 26 for locking or unlocking the upper frame 20. Thus the work for opening or shutting the upper frame 20 is troublesome and the work for removing the sheet is also troublesome.

Furthermore, in the case of using the lock lever 26, because it is needed to couple each ditch 56 with the corresponding coupling bar 28, when either of the ditches 56 is not securely coupled with the corresponding coupling bar 28, it is impossible to lock the upper frame 20 with the under frame 21. Thus, there are some possibilities that the sheet will be sent off-line.

SUMMARY OF THE INVENTION

To solve the conventional problems mentioned above, the present invention supplies a medium supplying apparatus not only capable of easily removing medium, for example, a sheet, but also capable of preventing the slanting movement of the sheet or the bad transfer of the sheet.

According to the invention, there is provided a medium supplying apparatus, comprising:

a first frame which includes a first rotating section that rotates freely, a first fulcrum coupling section constructing a rotating fulcrum and a first lock coupling section;

a second frame that rotates freely with respect to the first frame and which includes a pressing member, a second fulcrum coupling section constructing the rotating fulcrum by being coupled with the first fulcrum coupling section, and a second lock coupling section coupled selectively with the first lock coupling section, wherein the first lock coupling section and the second lock coupling section are coupled selectively by relative movement of the first and second frames so as to lock or unlock the second frame with respect to the first frame.

In the medium supplying apparatus, the first rotating section and the pressing member are coupled while the first lock coupling section and the second lock coupling section are coupled, and a medium is conveyed by the first rotating section.

Further, in the medium supplying apparatus, the first fulcrum coupling section includes a first fitting portion used for regulating the rotation operations of the second frame with respect to the first frame, and a second fitting portion used for allowing the rotation operations of the second frame with respect to the first frame.

Moreover, in the medium supplying apparatus, the first lock coupling section includes an accepting portion for accepting the second lock coupling section, and a fitting portion coupled with the second lock coupling section.

Further, in the medium supplying apparatus, the first frame and the second frame construct a medium conveyance unit. The second frame is moved with respect to the first frame and a coupling situation of the first lock coupling section and the second lock coupling section is changed by moving the medium conveyance unit.

The above and other objects and features of the present invention will become apparent from the following detailed description and the appended claims with reference to the accompanying drawings.

DETAILED DESCRIPTION OF THE PREFERRED EMBODIMENTS

With respect to embodiments of the present invention, while referring to the diagrams, the following is to explain them in detail.

In the embodiments, serving as a recording apparatus, a printing apparatus will be explained. With respect to similar construction elements as those in a conventional printing apparatus, FIG. 2 will be used and similar explanations will be omitted.

<Embodiment 1>

Figure 1:
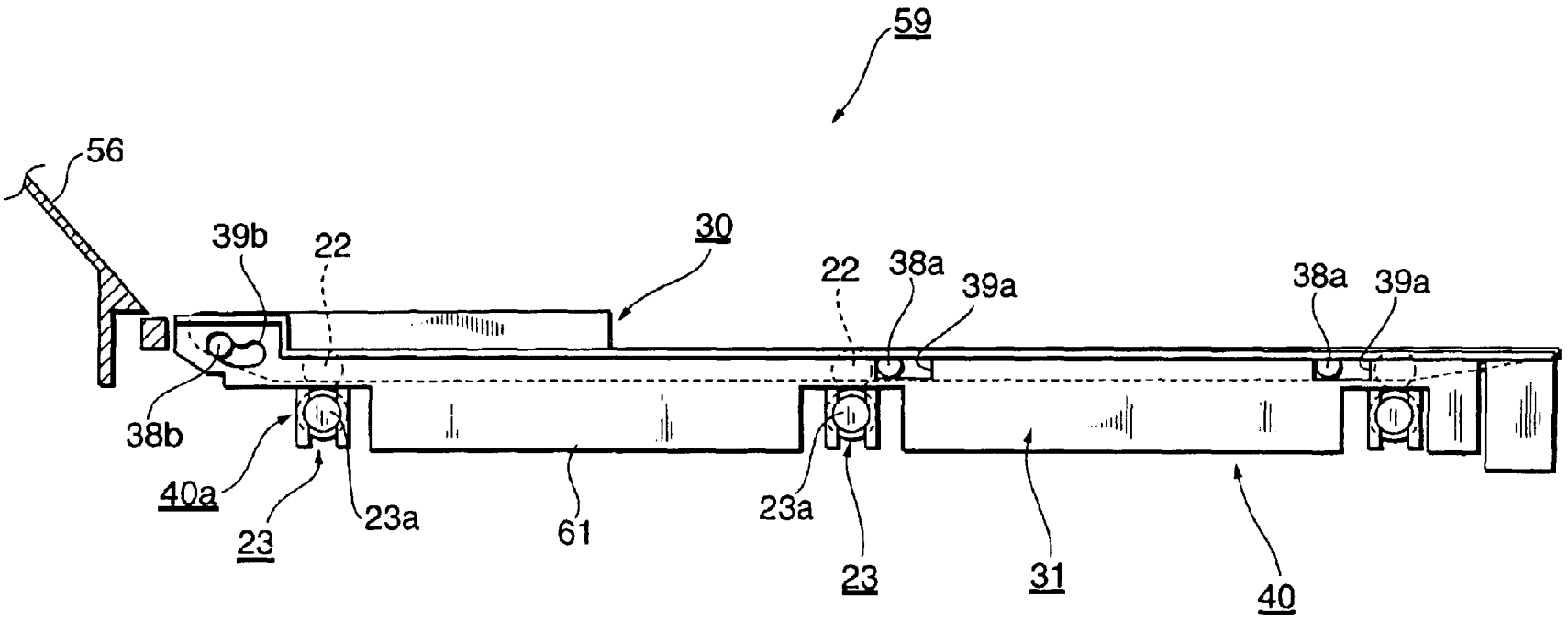
FIG. 1 is a front drawing showing the main part of a reversing unit of the present invention in embodiment 1 with an upper frame in a shut position.
Figure 2:
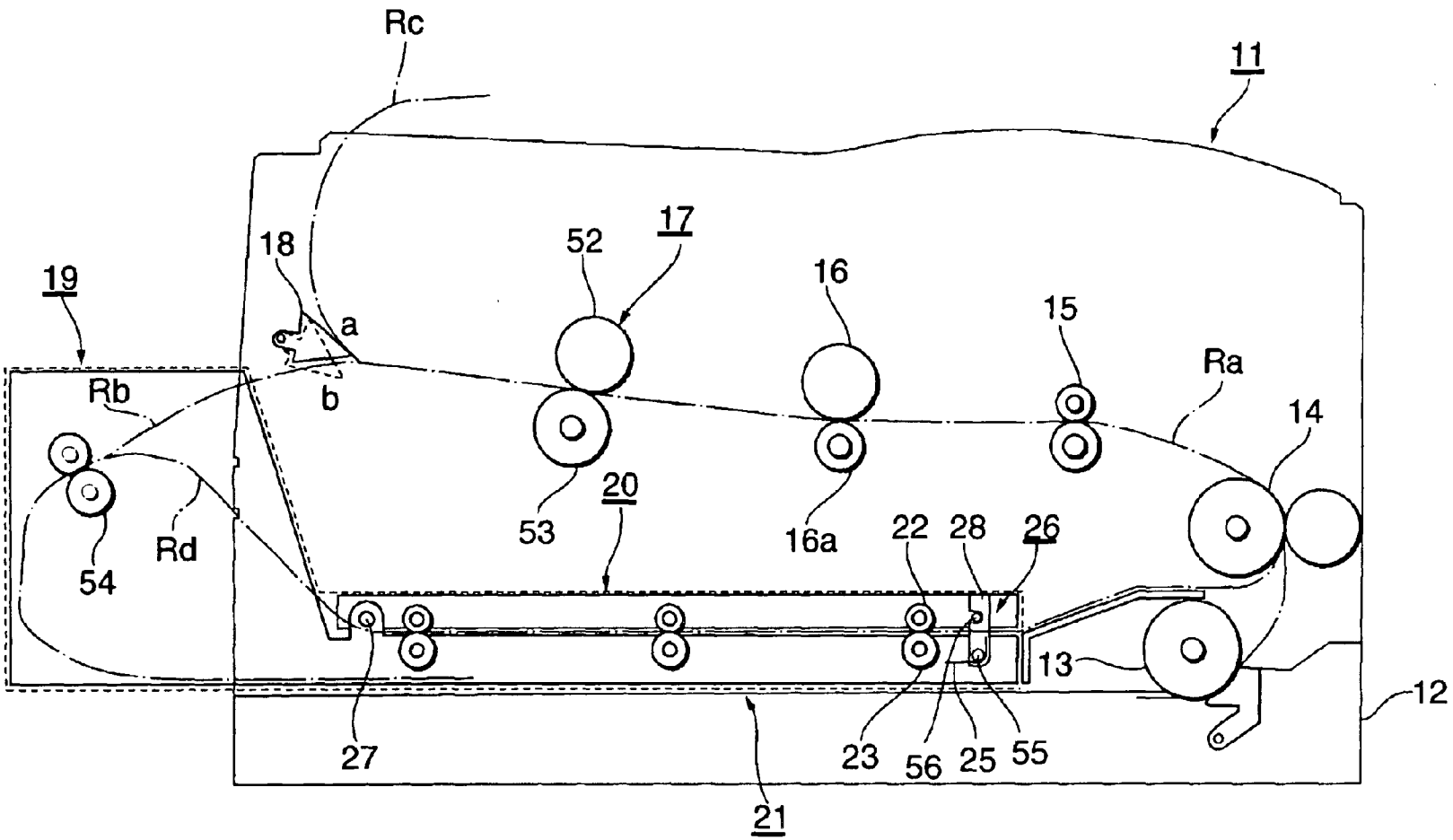
Fig.2 PRIOR ART
FIG. 2 is a summary drawing showing a conventional printing apparatus.
Figure 3:
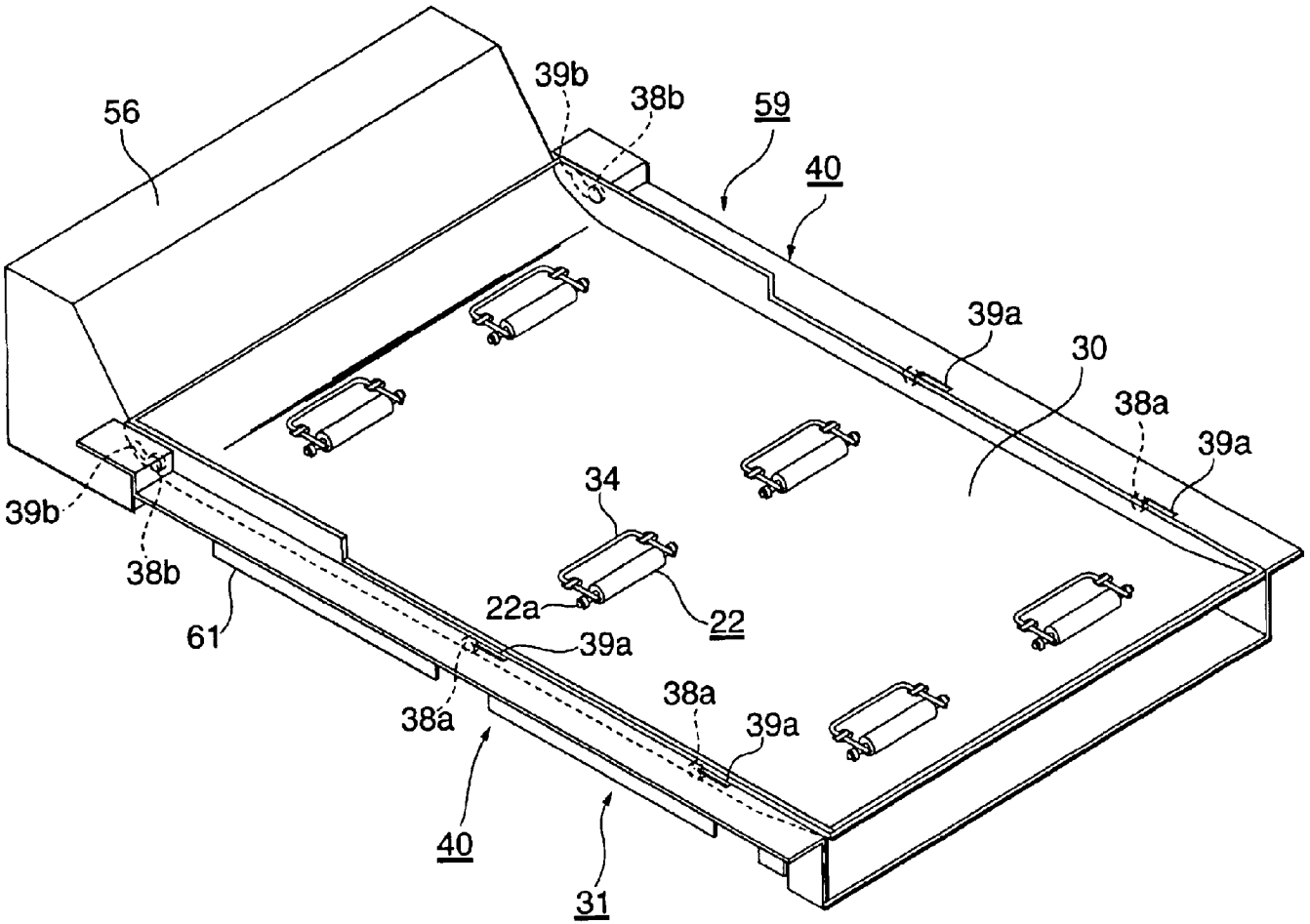
FIG. 3 is a perspective drawing showing the main part of the reversing unit in embodiment 1.
Figure 4:
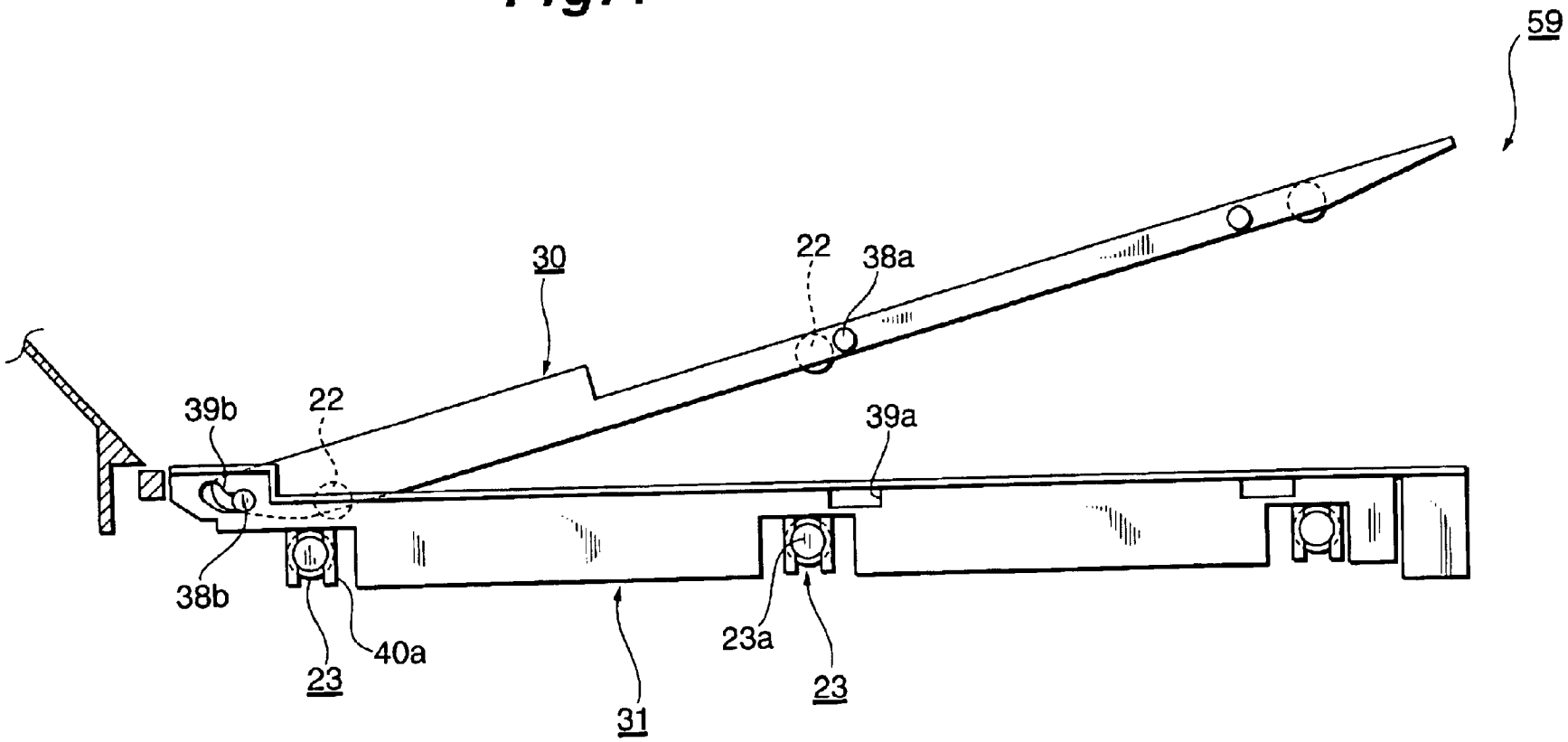
FIG. 4 is a front drawing showing the main part of a reversing unit of the present invention in embodiment 1, with the upper frame in an open position.
Figure 5:
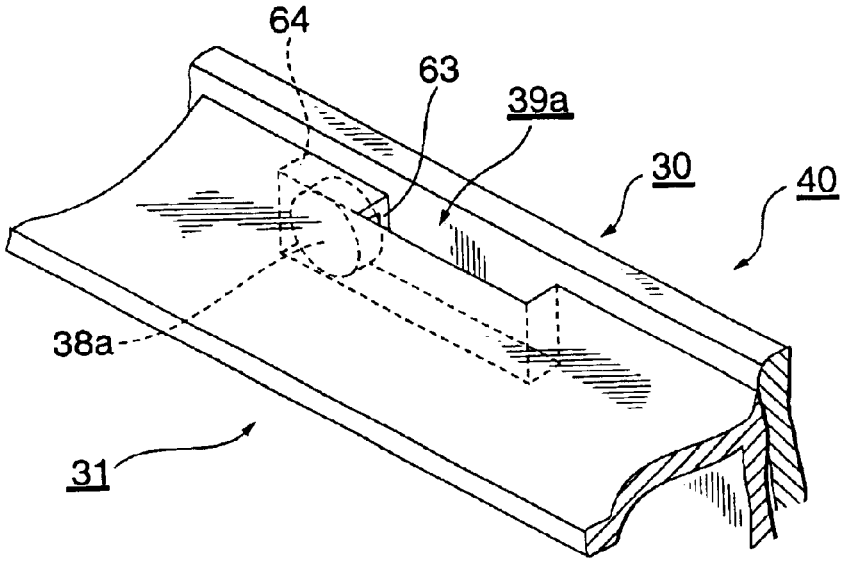
FIG. 5 is a first perspective drawing showing the coupling situation of a projecting section of the present invention in embodiment 1.
Figure 6:
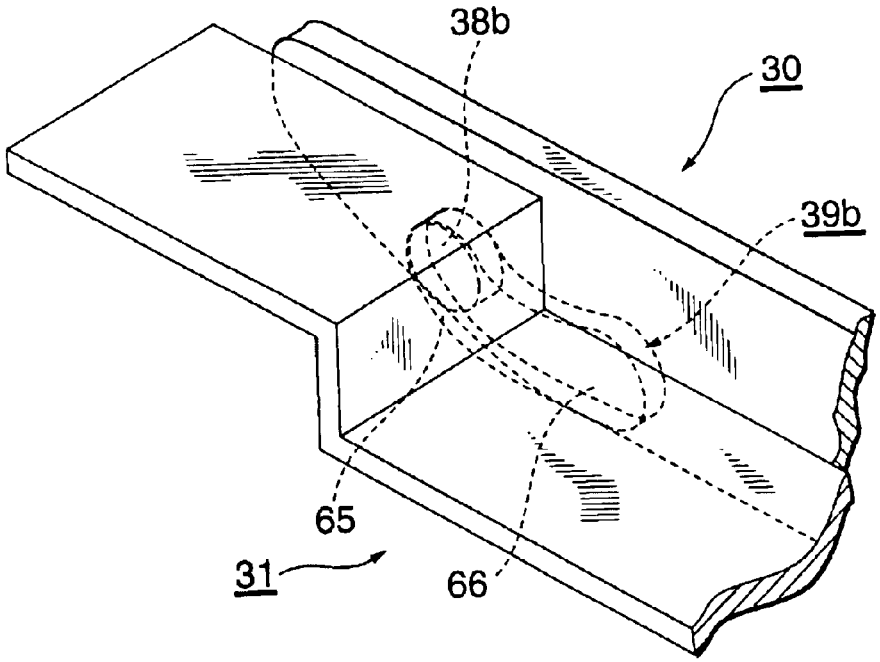
FIG. 6 is a second perspective drawing showing the coupling situation of a projecting section of the present invention in embodiment 1.
Figure 7:
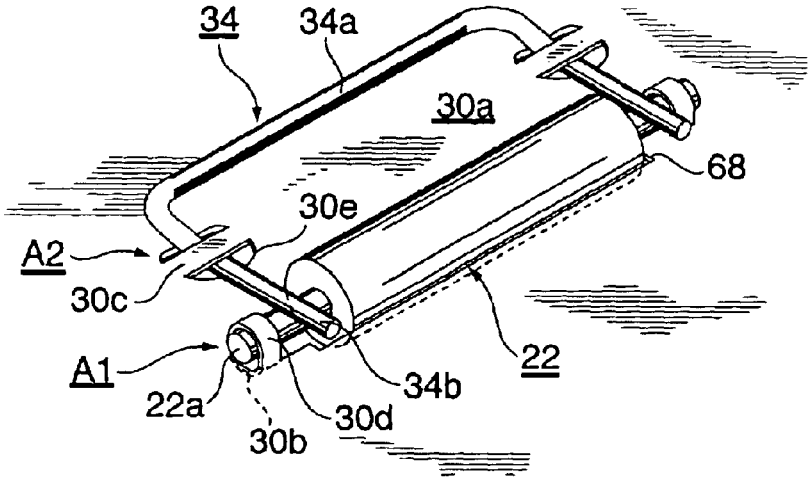
FIG. 7 is a perspective drawing showing the setting situation of a pinch roller of the present invention in embodiment 1.
Figure 8:
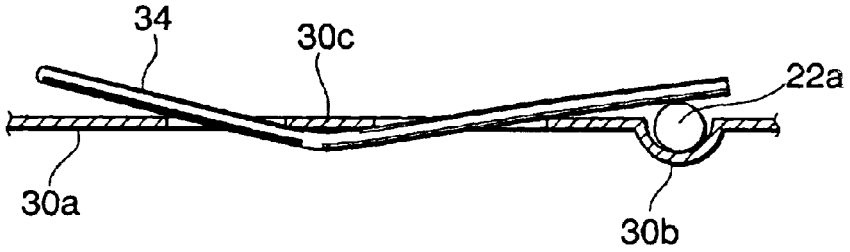
FIG. 8 is a cross-sectional drawing showing the setting situation of a pinch roller of the present invention in embodiment 1.
Figure 9:
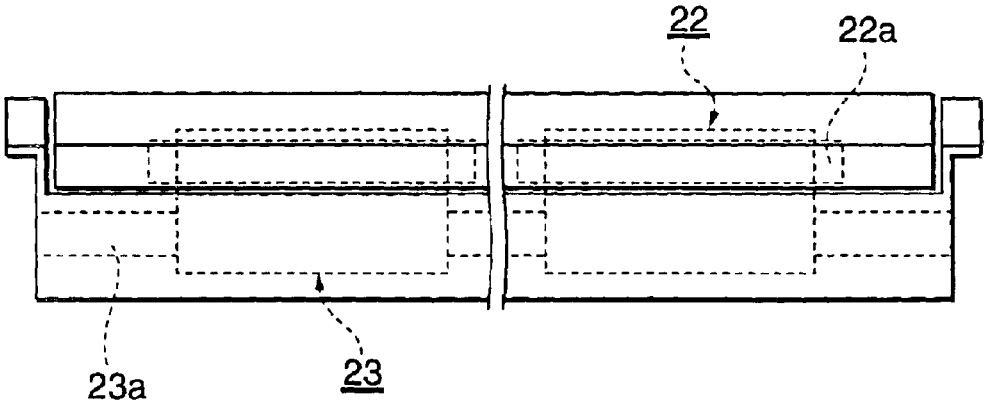
FIG. 9 is an explanation drawing indicating the relation between a pinch roller and a conveyance roller of the present invention in embodiment 1.

FIG. 1 is a front drawing showing the main part of a reversing unit of the present invention in embodiment 1 with the upper frame in a shut position; FIG. 2 is a summary drawing showing a conventional printing apparatus; FIG. 3 is a perspective drawing showing the main part of the reversing unit in embodiment 1; FIG. 4 is a front drawing showing the main part of a reversing unit of the present invention in embodiment 1 with the upper frame in an open position;

FIG. 5 is a first perspective drawing showing the coupling situation of a projecting section of the present invention in embodiment 1; FIG. 6 is a second perspective drawing showing the coupling situation of a projecting section of the present invention in embodiment 1; FIG. 7 is a perspective drawing showing the setting situation of a pinch roller of the present invention in embodiment 1; FIG. 8 is a cross-sectional drawing showing the setting situation of a pinch roller of the present invention in embodiment 1; and FIG. 9 is an explanation drawing indicating the relation between a pinch roller and a conveyance roller of the present invention in embodiment 1.

In these drawings, 59 is a reversing unit to serve as a medium conveying unit for duplex printing. The reversing unit 59, is set above the sheet cassette 12 serving as a medium supplying section, capable of being pulled out freely with respect to the printing apparatus 11. The reversing unit 59 comprises an upper frame 30 and a under frame 31, reverses the sheet medium and conveys the reversed sheet.

The under frame 31 includes an accommodating section 56 for accommodating the reversing roller 54, a bottom plate 61 extending from the bottom portion of the accommodating section 56 along the conveyance direction of sheet, and two side plates 40 extending upward from both edges of the bottom plate 61.

On each side plate 40, a plurality of first ditches 39*a*, or first ditch portions, and second ditches 39*b*, or second ditch portion, are respectively formed. The first ditches 39*a* are formed at the center and at the downstream conveyance direction of the sheet, and the second ditches 39*b* are formed at the upstream conveyance direction of the sheet and has a curved shape.

Moreover, the upper frame 30, under frame 31 and the like construct a medium supplying apparatus. Further, the under frame 31 serves as a first frame, and the upper frame 30 serves as a second frame.

The upper frame 30 is set such that it rotates freely and is capable of being installed or removed freely with respect to the under frame 31. Accordingly, corresponding to the second ditch 39*b*, at the upstream side of the upper frame 30 according to the conveyance direction of the sheet, a projecting section 38*b* is formed to serve as a rotating fulcrum. The projecting section 38*b* is mounted into the ditch 39*b*. When the upper frame 30 is opened or shut, the projecting section 38*b* and the ditch 39*b* form the rotating fulcrum.

Further, projecting sections 38*a*, corresponding to the first ditches 39*a*, are formed at the center and the downstream side of the upper frame 30 according to the conveyance direction of the sheet. Thus, when the upper frame 30 is set at the shut position as shown by FIG. 1, the projecting section 38*a* just fits into the ditch 39*a*, that is, the projecting section 38*a* is coupled with the ditch 39*a*. Thereby, the upper frame 30 is placed in a locked situation and the upper frame 30 is fixed on the under frame 31.

Moreover, the ditch 39*a* serves as a first lock coupling section, the projecting section 38*a* serves as a second lock coupling section, the ditch 39*b* serves as a first fulcrum coupling section, and the projecting section 38*b* serves as a second fulcrum coupling section.

The ditch 39*a* and the projecting section 38*a* are selectively coupled to each other when the upper frame 30 moves along the horizontal direction with respect to the under frame 31.

Thus, the upper frame 30 can be locked or unlocked. Accordingly, the ditch 39*a*, as shown by FIG. 5, opens upward on the upper edge of the side plate 40. The ditch 39*a* includes an accepting portion 63 for accepting the projecting section 38*a*, and a fitting portion 64 which is formed at the upstream side of the accepting portion 63 according to the conveyance direction of the sheet and is used to couple the projecting section 38*a* with the ditch 39*a* when the upper frame 30 is placed at the shut position.

Further, a shown by FIG. 6, the ditch 39*b* includes a first fitting portion 65 used for regulating the rotational operation of the upper frame 30 with respect to the under frame 31, and a second fitting portion 66 used for allowing the rotational operation of the upper frame 30 with respect to the under frame 31. When locking the upper frame 30 on the under frame 31, the projecting section 38*b* fits into the first fitting portion 65 and when unlocking the upper frame 30 from the under frame 31, the projecting section 38*a* fits into the second fitting portion 66 and the upper frame 30 opens and shuts freely. Moreover, compared to ditch 39*a*, ditch 39*b* contains no opening part. Thereby, when assembling, the projecting section 38*b* is inserted into the ditch 39*b* firm the inside of the side plate 40 of the under frame 31.

Further, on the upper frame 30, along the conveyance direction, three pairs of pinch rollers 22 are set such that they rotate freely, and each pair of pinch rollers 22 are symmetrical on right and left directions (that is, there are six pinch rollers 22 that are set symmetrically on right and left directions). On the under frame 31, corresponding to each pinch roller 22, six conveyance rollers 23 are installed to rotate freely. The conveyance rollers 23 construct a first rotating section and the pinch rollers 22 construct a second rotating section, that is, a pressing member.

On the pinch roller 22, an axis 22*a* is provided. The axis 22*a* is supported and is pressed downward to the conveyance roller 23 by a spring 34. The spring 34 indicates a curved bar shape, and is constructed of a basic part 34*a* and arm parts 34*b* which extend from the basic part 34*a* and is at a right angle to the basic part 34*a*. The edge of the arm part 34*b* is mounted at the ends of the axis 22*a*.

Accordingly, on the top portion 30*a* of the upper frame 30, a receiving portion 68 with a rectangular window is cut for receiving the pinch roller 22. Further, a first supporting portion A1 for supporting the pinch roller 22 to rotate freely, and a second supporting portion A2 for support of the spring 34 are formed by cutting.

The first supporting portion A1 is formed from a curved part 30*b* formed by transforming downward the part of the top portion 30*a*, corresponding to the axis 22*a*, into a semicircular shape, and a holding part 30*d* which is next to the curve part 30*b* and is formed by transforming upward into a semicircular shape. Then, by inserting the axis 22*a* between the curved part 30*b* and the holding part 30*d*, the pinch roller 22 is supported to rotate freely. Moreover, the holding part 30*d* is formed to leave some leeway for making the axis 22*a* move freely along the vertical direction.

Further, the second supporting portion A2 is formed from a holding part 30*c* formed by cutting the part corresponding to the arm part 34*b* into a belt shape, and a curved part 30*e*, which is next to the holding part 30*c*, formed by transforming downward into a semicircular shape. Then, by inserting the arm part 34*b* in between the holding part 30*c* and the curved part 30*e*, the spring 34 is fixed at the upper frame 30.

Thus, after the tip of each arm part 34*b* is pressed into the axis 22*a*, the pinch roller 22 follows downward by the spring force of the spring 34.

Moreover, on the side plate 40, three supporting portions 40*a* are formed to open downward. By making the axis 23*a* coupled with the supporting portion 40*a*, the conveyance roller 23 is supported and capable of rotating freely. The conveyance roller 23 and the pinch roller 22 are set such that they are pressed or separated freely from each other. When the projecting section 38*a* fits into the ditch 39*a*, the conveyance roller 23 is pressed by the pinch roller 22. Accordingly, the width of the both tips of the supporting portion 40*a* is set to be smaller than the diameter of the axis 23*a*. Moreover, the axis 23*a* is formed by an elastic material and the conveyance roller 23 is supported elastically with respect to the under frame 31.

Next, the operations when locking the upper frame 30 on the under frame 31 is explained.

Figure 10:
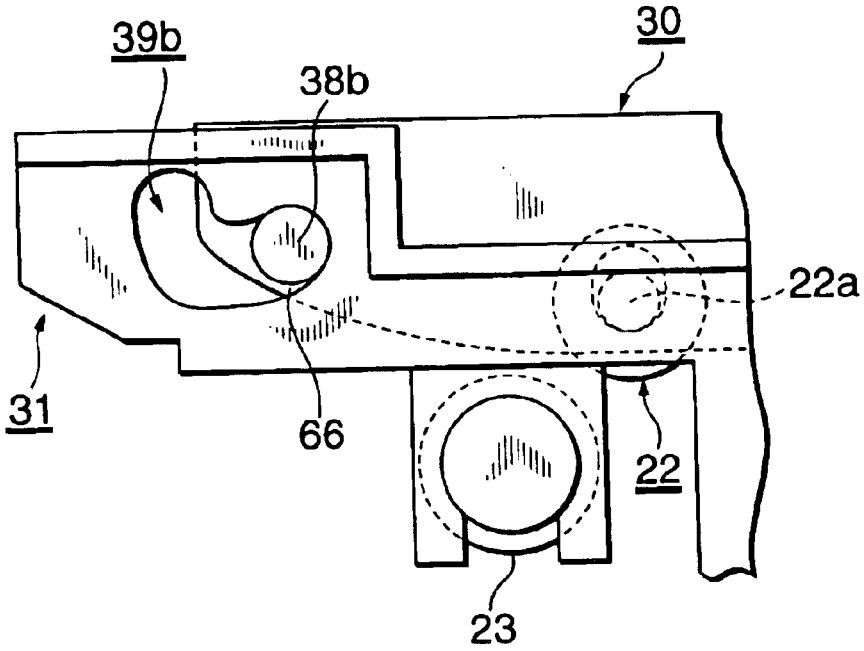
FIG. 10 is a first explanation drawing for explaining the operations when the upper frame is set at the shut position in embodiment 1.
Figure 11:
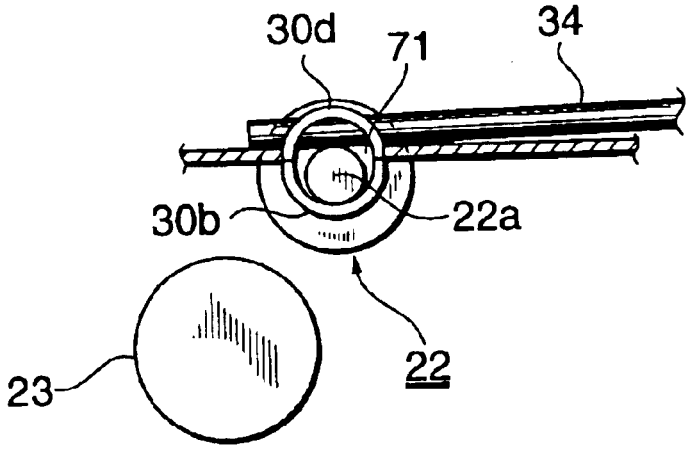
FIG. 11 is a second explanation drawing for explaining the operations when the upper frame is set at the shut position in embodiment 1.
Figure 12:
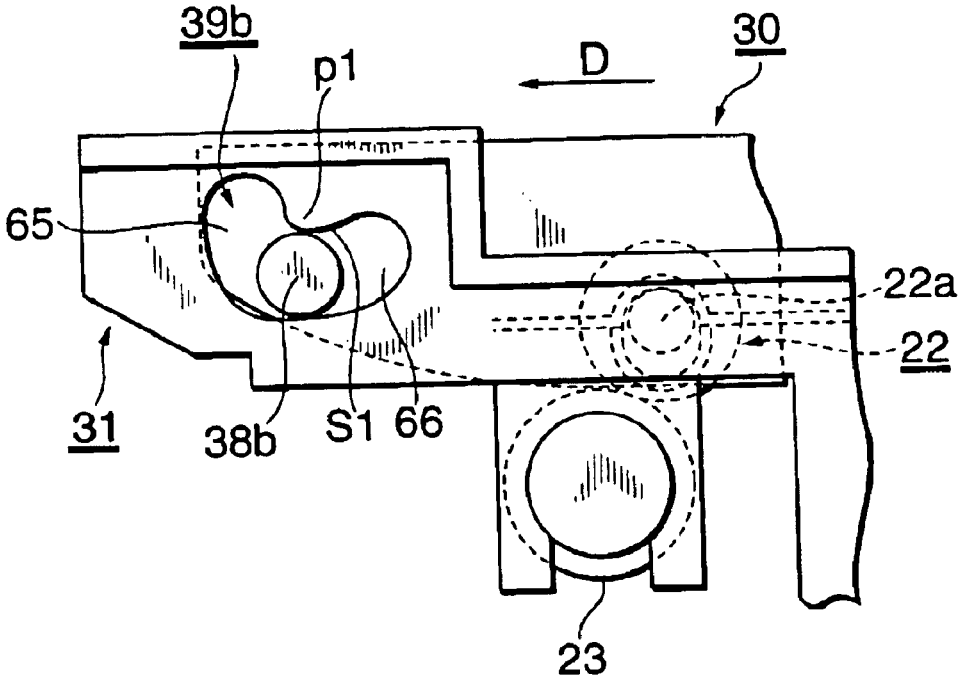
FIG. 12 is a third explanation drawing for explaining the operations when the upper frame is set at the shut position in embodiment 1.
Figure 13:
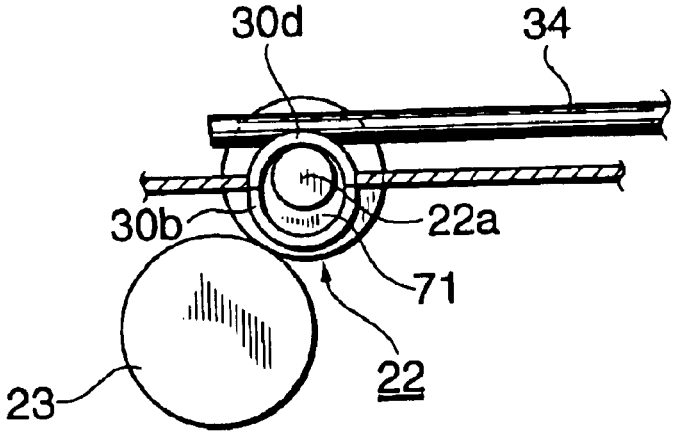
FIG. 13 is a fourth explanation drawing for explaining the operations when the upper frame is set at the shut position in embodiment 1.
Figure 14:
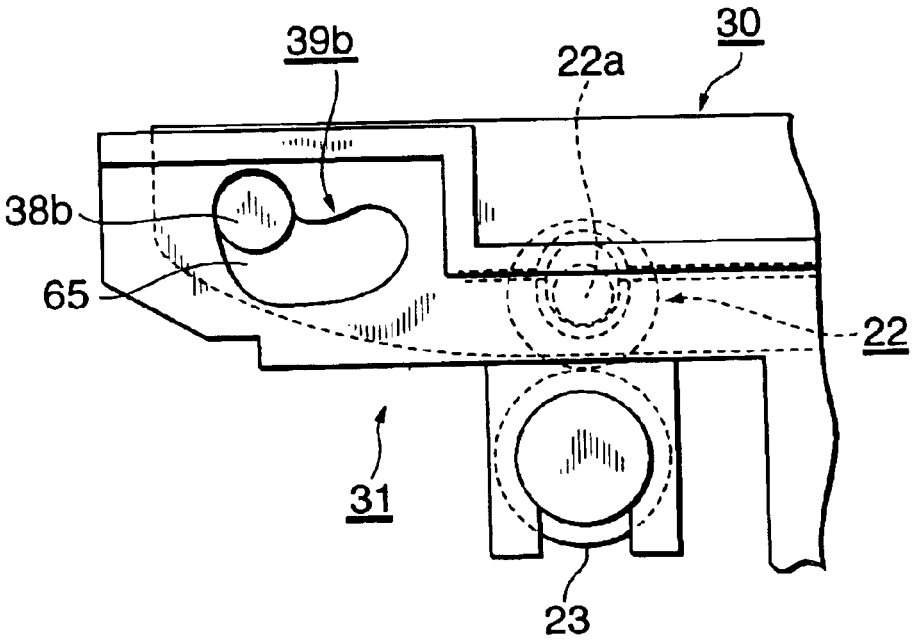
FIG. 14 is a fifth explanation drawing for explaining the operations when the upper frame is set at the shut position in embodiment 1.

FIG. 10 is a first explanation drawing for explaining the operations when the upper frame is set at the shut position in embodiment 1; FIG. 11 is a second explanation drawing for explaining the operations when the upper frame is set at the shut position in embodiment 1; FIG. 12 is a third explanation drawing for explaining the operations when the upper frame is set at the shut position in embodiment 1; FIG. 13 is a fourth explanation drawing for explaining the operations when the upper frame is set at the shut position in embodiment 1; FIG. 14 is a fifth explanation drawing for explaining the operations when the upper frame is set at the shut position in embodiment 1; and FIG. 15 is a sixth explanation drawing for explaining the operations when the upper frame is set at the shut position in embodiment 1.

On one hand, FIGS. 10 and 11 indicate a situation when the upper frame 30 is unlocked with respect to the under frame 31. In this case, the projecting section 38*b* fits into the second fitting portion 66 of the ditch 39*b*, and pinch roller 22 is separated from the conveyance roller 23. Moreover, the axis 22*a* of the pinch roller 22, as shown by FIG. 11, is set in between the curved part 30*b* and the holding part 30*d*, and is pressed downward by the spring 34 in the hole 71 having a near elliptical shape.

Further, as shown by FIG. 12, when the upper frame 30 is moved along a direction arrow D, the projecting section 38*b* is moved toward the first fitting portion 65 from the second fitting portion 66 along a slanting plane S1 of a convex portion P1 formed in between the first fitting portion 65 and the second fitting portion 66 of the ditch 39*b*. At that time, as shown by FIG. 13, the pinch roller 22 comes in contact with the conveyance roller 23, and the axis 22*a* of the pinch roller 22 is moved upward by the elastic force of the spring 34 in the hole 71.

Figure 15:
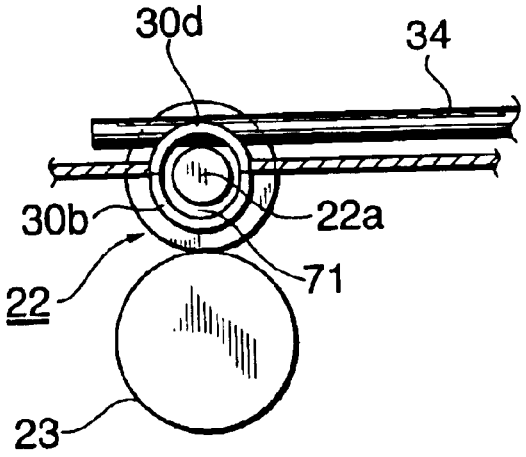
FIG. 15 is a sixth explanation drawing for explaining the operations when the upper frame is set at the shut position in embodiment 1.

On the other hand, FIGS. 14 and 15 indicate a situation where the upper frame 30 is locked in with the under frame 31 and is placed at the shut position.

In this case, the projecting section 38*b* fits into the first fitting portion 65 of the ditch 39*b*, and pinch roller 22 is pressed against the conveyance roller 23. Moreover, though the axis 22*a* of the pinch roller 22, as shown by FIG. 15, is pressed downward by the spring 34 in the hole 71, because the pinch roller 22 and the conveyance roller 23 are pressed against each other, the axis 22*a* is placed against the elastic force of the spring 34, at the upper position above the bottom side of the hole 71.

Because the first fitting portion 65 is stopped upward, in the situation that the upper frame 30 is locked on the under frame 31, the opening and shutting operations of the upper frame 30 are controlled.

Further, by pressing the upper frame downward and moving it along the direction opposite the direction arrow D, the upper frame 30 is unlocked with respect to the under frame 31. Thus, it is possible to open the upper frame 30.

Therefore, when the reversing unit 59 is clogged with a sheet, the reversing unit 59 is first pulled out from the printing apparatus 11, then the upper frame 30 is simply pressed downward and moved along the opposite direction of the direction arrow D to unlock the upper frame 30 with respect to the under frame 31. By placing the upper frame 30 at an open position, it is possible to remove the sheet.

As described in the embodiment above, by simply moving the upper frame 30 along a substantially horizontal direction, the upper frame 30 can be locked or unlocked with respect to the under frame 31. Thereby, not only are the number of parts for opening and shutting the upper frame 30 reduced, but the work for opening and shutting the upper frame 30 is simplified. Therefore, even if the reversing unit 59 is clogged with a sheet, the work for removing the sheet can be simplified.

Further, because the upper frame 30 can be locked securely on the under frame 31, it is possible to prevent the sheet from slanting or a bad transfer.

In embodiment 1, the pinch roller 22, serving as rotating section and included in the upper frame 30, is used as a member to press against the conveyance roller 23 of the under frame 31. It is possible to replace the pinch roller 22 with other pressing members that do not rotate so long as the conveyance roller 23 is pressed.

Further, in embodiment 1, the plural pinch rollers 22 are formed to correspond to respective conveyance rollers 23. It is possible to replace these pinch rollers 22 with a plate member serving as a pressing member, to make contact with all of the plural conveyance rollers 23.

<Embodiment 2>

Next, embodiment 2 of the present invention is explained. Moreover, in embodiment 2, for the same construction elements present in the above embodiment, the same mark is used and some same explanations are omitted.

Figure 16:
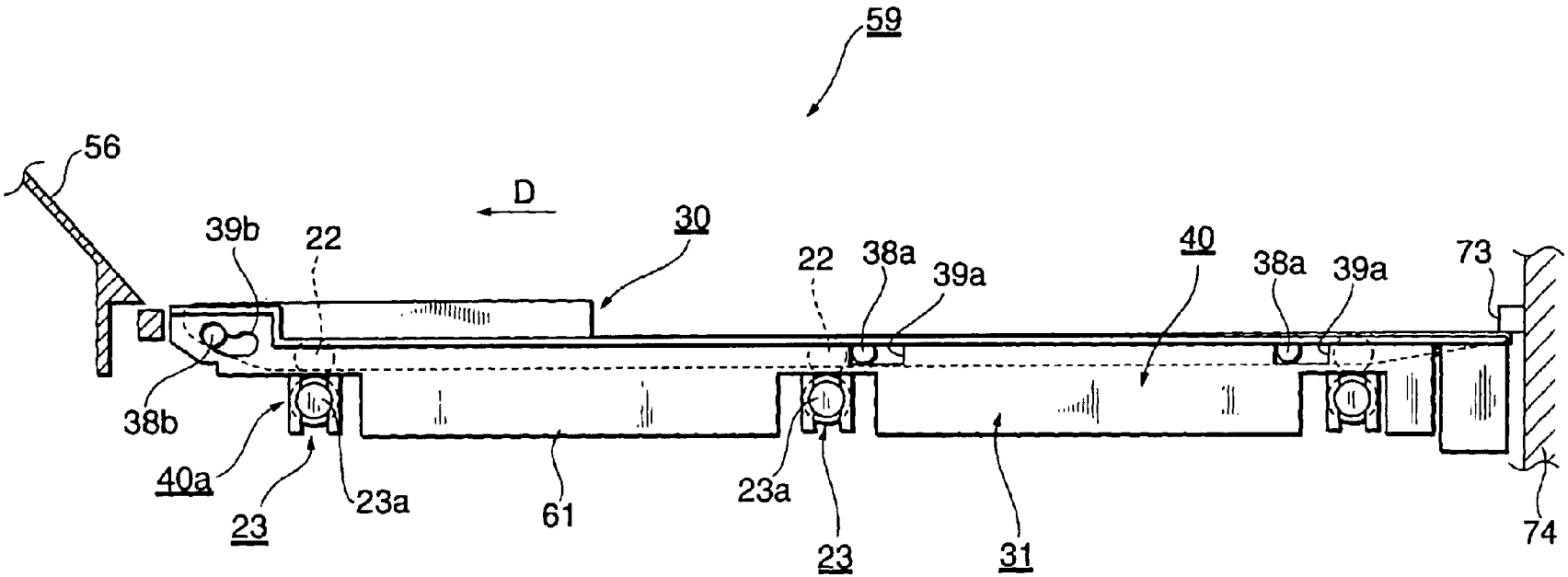
FIG. 16 is a front drawing showing the main part of a reversing unit of the present invention in embodiment 2, which is placing in a situation whose upper frame is set at a shut position.

FIG. 16 is a front view showing the main part of a reversing unit of the present invention in embodiment 2 that is placed in a situation whose upper frame is set at a shut position.

In FIG. 16, 73 is a contacting section formed at a predetermined position, i.e. the front edge (in FIG. 16, the right edge) of the upper frame 30 serving as a second frame. 74 is a wall section, or a restricting section, formed at a predetermined position of the printing apparatus 11 (referring to FIG. 2) serving as a recording apparatus facing the contacting section 73, and has a stopper function.

In such case, the sheet serving as medium is removed and when the reversing unit 59 serving as a medium conveyance unit is pushed forward (in FIG. 16, toward the right), the contacting section 73 makes contact with the wall section 74. Thus, while the upper frame 30 is restricted to further move forward, the under frame 31 serving as a first frame can be further moved forward. Thereby, the upper frame 30 moves along the direction arrow D with respect to the under frame 31.

As a result, the upper frame 30 is locked on the under frame 31 and is placed in a shut position.

As stated above, by moving the reversing unit 59, the upper frame 30 can move with respect to the under frame 31 along the substantially horizontal direction, and the fitting situation of the ditch 39*a* serving as a first lock coupling section and the projecting section 38*a* serving as a second lock coupling section can be changed. Thereby, after removing the sheet, by simply pushing the reversing unit 59 forward, the upper frame 30 can be locked on the under frame 31. Therefore, the work for shutting the upper frame 30 and the work for removing the sheet can be more simplified.

Further, when setting the reversing unit 59 into the printing apparatus 11, because the upper frame 30 can be locked naturally on the under frame 31, the upper frame 30 would lock even if a user were to forget.

<Embodiment 3>

Next, embodiment 3 of the present invention is explained. Moreover, in embodiment 3, for the same construction elements present in the above embodiments, the same mark is used and some same explanations are omitted.

Figure 17:
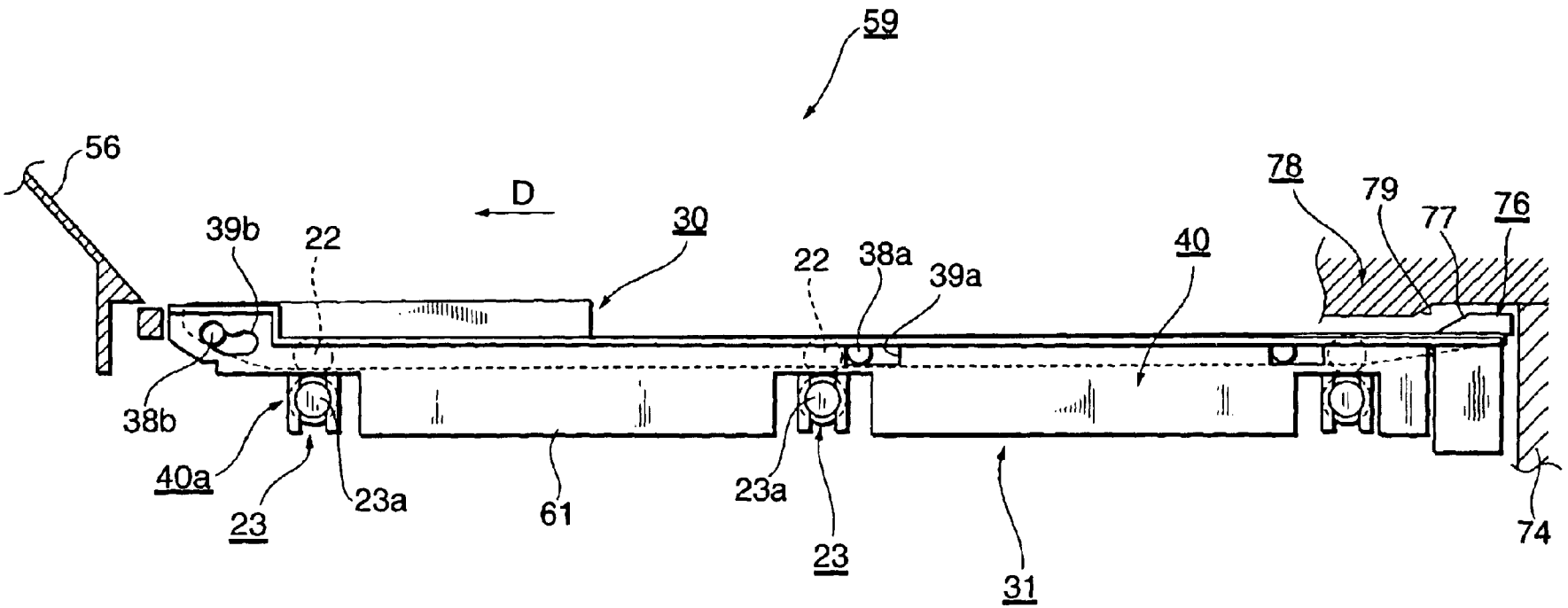
FIG. 17 is a front drawing showing the main part of a reversing unit of the present invention in embodiment 3, which is placing in a situation whose upper frame is set at a shut position.

FIG. 17 is a front view showing the main part of a reversing unit of the present invention in embodiment 3 in a situation whose upper frame is set at a shut position.

In FIG. 17, 76 is a contacting section formed at a predetermined position, i.e. the front edge (in FIG. 17, the right edge) of the upper frame 30 serving as a second frame. 74 is a wall section, or a first restricting section, formed at a predetermined position of the printing apparatus 11 (referring to FIG. 2) serving as a recording apparatus facing the contacting section 76, and has a stopper function. 78 is a wall section, as a second restricting section, formed at a predetermined position of the printing apparatus 11 set above the upper frame 30 and has an inclination function.

On the back edge (in FIG. 17, the left edge) of the contacting section 76, an inclined plane 77 as a first inclining portion is formed. On the wall section 78, corresponding to the inclined plane 77, an inclined plane 79 as a second inclining portion is also formed.

In such case, when the reversing unit 59 serving as a medium conveyance unit is clogged with a sheet, while pulling the reversing unit 59 out from the printing apparatus 11, the upper frame 30 moves backward (in FIG. 17, toward the left). Then, while the inclined plane 79 is touched by the inclined plane 77, the upper frame 30 is pressed downward. Thus, the upper frame 30 is unlocked with respect to the under frame 31 serving as a first frame, and it is possible to place the upper frame 30 at the open position and remove the sheet. Moreover, by setting smaller the respective inclination angles of the inclined planes 77 and 79, the upper frame 30 can be moved backward by a smaller force.

Then, after removing the sheet serving as medium, when pushing forward (in FIG. 17, toward the right) the reversing unit 59 serving as a medium conveyance unit, the contacting section 76 contacts the wall section 74. Thus, while the upper frame 30 is restricted to further move forward, the under frame 31 serving as a first frame can be further moved forward. Thereby, the upper frame 30 moves along the direction arrow D with respect to the under frame 31. As a result, as stated in embodiment 2, the upper frame 30 is locked on the under frame 31 and is placed in a shut position.

As stated above, by moving the reversing unit 59, the upper frame 30 can move with respect to the under frame 31 along the substantially horizontal direction and the substantially vertical direction, and the fitting situation of the ditch 39*a* serving as a first lock coupling section and the projecting section 38*a* serving as a second lock coupling section can be changed. Thereby, by simply pulling out the reversing unit 59, the upper frame 30 can be unlocked with respect to the under frame 31. Then, after removing the sheet, by simply pushing forward the reversing unit 59, the upper frame 30 can be locked on the under frame 31. Therefore, the work for shutting the upper frame 30 and the work for removing the sheet can be more simplified.

Further, when setting the reversing unit 59 into the printing apparatus 11, because the upper frame 30 can be locked naturally on the under frame 31, the upper frame 30 would lock even if a user were to forget.

According to the present invention, the medium supplying apparatus comprises a first frame and a second frame set such that it rotates freely with respect to the first frame. The first frame includes a first rotating section that rotates freely, a first fulcrum coupling section constructing a rotating fulcrum and a first lock coupling section. The second frame includes a pressing member, a second fulcrum coupling section constructing the rotating fulcrum by being coupled with the first fulcrum coupling section, and a second lock coupling section coupled selectively with the first lock coupling section.

Further, the first and second lock coupling sections are coupled selectively by relative movement of the first and second frames. Thus, the second frame is locked or unlocked with respect to the first frame.

Thereby, not only are the number of parts for opening and shutting the second frame reduced, but also the work for opening and shutting the second frame can be simplified. Therefore, even if the medium conveyance unit is clogged with medium, the work for removing the medium can be simplified.

Further, because the second frame can be locked securely on the first frame, it is possible to prevent the sheet from slanting or a bad transfer.

The present invention is not limited to the foregoing embodiments but many modifications and variations are possible within the spirit and scope of the appended claims of the invention.

What is claimed is:

1. A medium supplying apparatus, comprising:

a first frame which includes a first rotating section that rotates freely, a first fulcrum coupling section constructing a rotating fulcrum and a first lock coupling section;

a second frame that rotates freely with respect to said first frame and which includes a pressing member, a second fulcrum coupling section constructing said rotating fulcrum by being coupled with said first fulcrum coupling section, and a second lock coupling section coupled selectively with said first lock coupling section, wherein said first lock coupling section and said second lock coupling section are coupled selectively by relative movement of the first and second frames so as to lock or unlock said second frame with respect to said first frame.

2. The medium supplying apparatus according to claim 1, wherein said first rotating section and said pressing member are coupled while said first lock coupling section and said second lock coupling section are coupled, a medium is conveyed by said first rotating section.

3. The medium supplying apparatus according to claim 1, wherein said first fulcrum coupling section includes a first fitting portion used for regulating the rotation operations of said second frame with respect to said first frame, and a second fitting portion used for allowing the rotation operations of said second frame with respect to said first frame.

4. The medium supplying apparatus according to claim 1, wherein said first lock coupling section includes an accepting portion for accepting said second lock coupling section, and a fitting portion coupled with said second lock coupling section.

5. The medium supplying apparatus according to claim 1, wherein said frame and said second frame construct a medium conveyance unit, said second frame is moved with respect to said first frame and a coupling situation of said first lock coupling section and said second lock coupling section is changed, by moving said medium conveyance unit.

* * * * *